US010148046B2

(12) United States Patent
Schlepp et al.

(10) Patent No.: US 10,148,046 B2
(45) Date of Patent: Dec. 4, 2018

(54) HOLDING FRAME FOR PLUG CONNECTOR MODULES

(71) Applicant: HARTING Electric GmbH & Co. KG, Espelkamp (DE)

(72) Inventors: Ramona Schlepp, Essen (DE); Bernard Schlegel, Rahden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/548,068

(22) PCT Filed: Jan. 28, 2016

(86) PCT No.: PCT/DE2016/100031
§ 371 (c)(1),
(2) Date: Aug. 1, 2017

(87) PCT Pub. No.: WO2016/124173
PCT Pub. Date: Aug. 11, 2016

(65) Prior Publication Data

US 2018/0026405 A1 Jan. 25, 2018

(30) Foreign Application Priority Data

Feb. 2, 2015 (DE) ..... 10 2015 101 433

(51) Int. Cl.
*H01R 13/502* (2006.01)
*H01R 13/60* (2006.01)
(Continued)

(52) U.S. Cl.
CPC ..... *H01R 13/73* (2013.01); *H01R 13/518* (2013.01); *H01R 13/514* (2013.01)

(58) Field of Classification Search
CPC ..... H01R 13/514; H01R 13/518
See application file for complete search history.

(56) References Cited

U.S. PATENT DOCUMENTS 6,004,162 A 12/1999 Harting et al.
7,316,591 B2 * 1/2008 Ferderer ..... H01R 13/506 439/532
(Continued)

FOREIGN PATENT DOCUMENTS

CN 202084755 U 12/2011
CN 202797438 U 3/2013
(Continued)

OTHER PUBLICATIONS

German Office Action, dated Jan. 14, 2016, for German Application No. 10 2015 101 433.5, 4 pages.
(Continued)

*Primary Examiner* — Xuong Chung Trans
(74) *Attorney, Agent, or Firm* — Seed IP Law Group LLP

(57) ABSTRACT

The disclosure relates to a plug connector for plug connector modules and for installation in plug connector housings or for screwing to wall surfaces. The holding frame is composed of two opposite sides in which there are provided recesses for receiving the plug connector modules. The holding frame is composed of four interconnected parts. A first side part and a second, opposite side part form the sides of the holding frame. A first head part and a second head part are provided on the ends of the side parts. The side parts are connected to one another via the head parts. Furthermore, the head parts have fastening ends by way of which the holding frame can be fastened in a plug connector housing or to a wall surface.

15 Claims, 4 Drawing Sheets

(51) Int. Cl.

| | |
|---|---|
| ***H01R 13/73*** | (2006.01) |
| ***H01R 13/518*** | (2006.01) |
| *H01R 13/514* | (2006.01) |

(56) References Cited

U.S. PATENT DOCUMENTS

| | | | | |
|---|---|---|---|---|
| 9,577,365 | B1 * | 2/2017 | Herbrechtsmeier | H01R 13/518 |
| 9,865,958 | B2 * | 1/2018 | Beischer | H01R 13/512 |
| 2003/0194914 | A1 * | 10/2003 | Duck | G02B 6/381 439/701 |

FOREIGN PATENT DOCUMENTS

| | | | |
|---|---|---|---|
| CN | 203326246 | U | 12/2013 |
| CN | 204271392 | U | 4/2015 |
| DE | 197 07 120 | C1 | 6/1998 |
| DE | 20 2012 103 360 | U1 | 3/2013 |
| DE | 20 2013 103 611 | U1 | 11/2013 |
| DE | 10 2013 113 974 | A1 | 6/2015 |
| EP | 0 749 178 | A2 | 12/1996 |
| EP | 0 836 246 | A1 | 4/1998 |
| GB | 965560 | A | 7/1964 |
| JP | 2888337 | B2 | 2/1999 |
| KR | 10-0291296 | B1 | 6/2001 |
| RU | 71 482 | U1 | 3/2008 |

OTHER PUBLICATIONS

International Search Report and Written Opinion, dated May 6, 2016, for International Application No. PCT/DE2016/100031, 11 pages. (with English Translation of Search Report).

International Preliminary Report on Patentability, dated Aug. 8, 2017, for International Application No. PCT/DE2016/100031, 9 pages. (English Translation).

Russian Search Report, dated May 5, 2018, for Russian Application No. 2017124984/07(043140), 2 pages.

Harting Elektronik GmbH, "Schwere Steckverbinder Han-Modular®," Product Catalog, Jan. 1999, 44 pages.

Korean Office Action, dated Jul. 19, 2018, for Korean Application No. 10-2017-7024308, 7 pages. (with English Translation).

* cited by examiner

HOLDING FRAME FOR PLUG CONNECTOR MODULES

BACKGROUND

Technical Field

This disclosure is related to a holding frame for holding plug connector modules for installing in a plug connector housing or for screwing to wall surfaces.

Description of the Related Art

Holding frames of the aforementioned type are used to hold plug connector modules, wherein the holding frame is fitted with various plug connector modules and subsequently inserted into a plug connector housing and is screwed to said plug connector housing. It is necessary for the holding frame to be mechanically stable in order to be able to withstand plugging forces and pulling forces that occur when joining together or separating the plug connection.

GB PS 965 560 discloses a rectangular, divided holding frame that comprises fastening means that are used to fasten the unit in a plug connector housing. The fastening of the plug connector modules occurs in this frame in a positive-locking manner.

The company publication from the company HARTING Elektronik GmbH "Schwere Steckverbinder, Han Modular, 16 3" ("Heavy Plug Connectors, Han Modular System, 16 3") dated 20 Jun. 1995 furthermore discloses an essentially rectangular holding frame that is provided with side walls that extend at a right angle with respect to the assembly plane. The plug connector modules are provided with latching hooks that latch with the side walls when inserting the plug connector modules into the holding frame and are consequently fixedly held in said holding frame.

Furthermore, a holding frame for holding plug connector modules is disclosed in DE 197 07 120 C1, said holding frame being embodied from two halves that are connected to one another in an articulated manner. The plug connector modules are inserted into a longitudinal side of the folded holding frame and are fixed by the second longitudinal side by means of a parallel alignment of the two longitudinal sides with respect to one another. The longitudinal sides are oriented at a right angle with respect to the fastening plane.

A disadvantage in the case of the holding frame disclosed in the prior art is that it is only possible to insert plug connector modules into the holding frame or remove said plug connector modules from the holding frame from a defined side of the holding frame. Moreover, the known holding frame can only receive a limited number of plug connector modules. A larger construction would be too unstable.

BRIEF SUMMARY

Embodiments of the present invention provide a holding frame of the type mentioned in the introduction so that the plug connecting modules can be installed and uninstalled in a variable as possible manner. It is to be possible to assemble plug connecting modules together with the connected cables from two sides of the holding frame. However, it is to be ensured that the holding frame comprises a high magnitude of mechanical stability in order to withstand the plugging and pulling forces when joining together or separating a plug connection.

The disclosure relates to a holding frame for holding plug connector modules. The holding frame is provided for installing in the plug connector housing or for screwing to wall surfaces. The holding frame comprises two opposite-lying sides that comprise cut-outs that are suitable for receiving the plug connector modules. The plug connector modules can be inserted in a positive-locking manner into the cut-outs with corresponding formations.

In order to assemble the plug connector modules in the holding frame, said holding frame is embodied from four parts: two opposite-lying side parts that form the sides of the holding frame and two head parts that are arranged on the end faces of the side parts. The head parts connect the side parts to one another in a mechanical manner. Recesses are provided in the head parts and said recesses can receive connecting regions of the side parts as receiving arrangements.

In a preferred embodiment, the receiving arrangements are configured as slots and the connecting regions of the side parts can be pushed into said slots. The connecting regions of the side parts in turn can be connected to one another by means of fastening means. Expediently, screws and nuts can be used as fastening means in order to render it possible to screw the connecting regions to one another.

A further preferred embodiment provides a purely mechanical, clamping connection between the side parts and head parts. For this purpose, the receiving arrangements of the head parts are configured as trapezoidal recesses. The shorter base side of the trapezoidal recess is used as the opening of the receiving arrangement.

The connecting region of the side parts can be used for assembly on one side into the trapezoidal recess. The connecting region can be entirely snapped into the trapezoidal recess by means of a tilting movement of the side part and thus can be clamped in the region of the larger base side of the trapezoidal recess.

Two opposite-lying recesses are configured in the connecting regions in order to prevent the connecting regions being pulled laterally out of the receiving arrangement. The connecting regions are clamped between the two recesses in the receiving arrangement so that it is not possible to laterally pull out the connecting regions.

Advantages that are achieved with embodiments of the invention reside in particular in the fact that it is possible to assemble and disassemble the plug connector modules without having to use specific tools. The holding frame can be dismantled into four components and can be combined around the plug connector modules. The plug connector modules can even be connected to cables and remain electrically contacted by the mating plug connector modules. A further advantage resides in the fact that the plug connector modules after installing the holding frame in a plug connector housing are fastened in the holding frame in a positive-locking manner and consequently overall a high magnitude of mechanical stability is present for receiving or transferring the plugging forces and pulling forces of the plug connection.

BRIEF DESCRIPTION OF THE SEVERAL VIEWS OF THE DRAWINGS

Two exemplary embodiments of the invention are illustrated in the drawings and are further explained hereinunder. In the drawings.

The figures include partially simplified, schematic illustrations. To some extent, identical reference numerals are used for identical but where appropriate non-identical elements. Different views of identical elements could be scaled differently.

DETAILED DESCRIPTION

Figure 1:
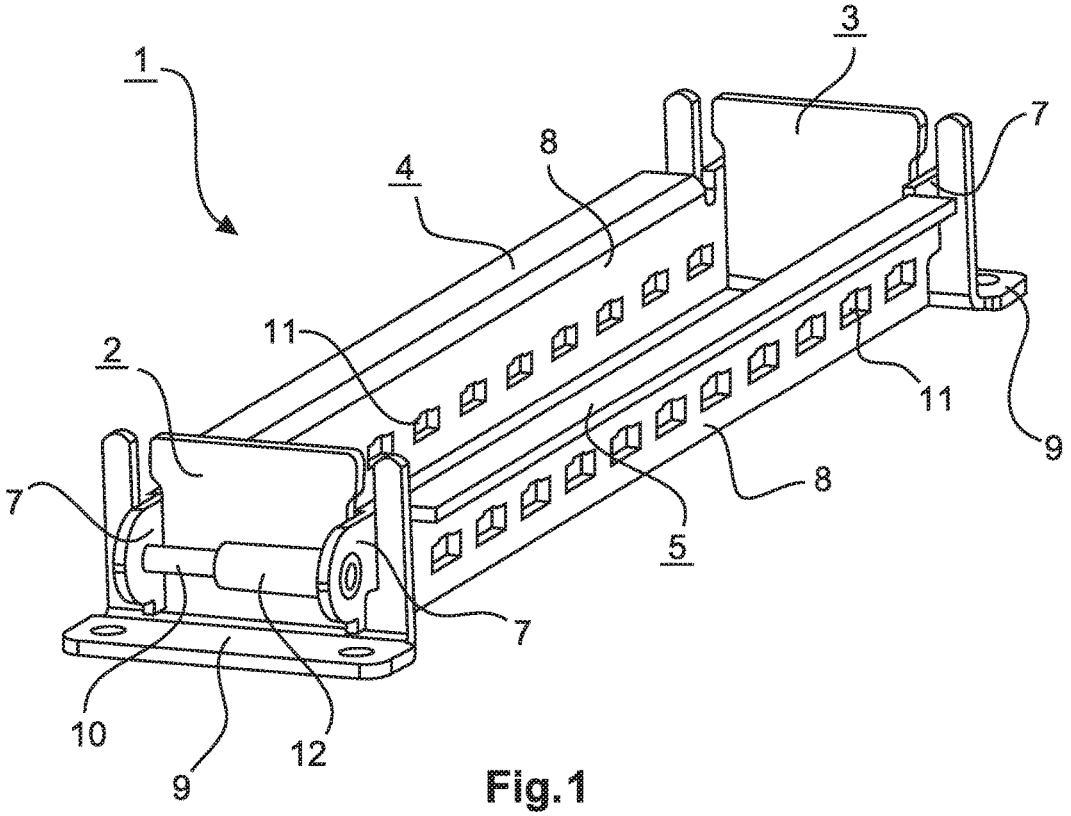
FIG. 1 illustrates a perspective view of a holding frame in accordance with a first exemplary embodiment of the invention.

FIG. 1 illustrates a perspective view of a holding frame 1 in accordance a first exemplary embodiment of the invention. The holding frame 1 is embodied from two sides 8 that are configured in a longitudinal manner. The sides are formed by virtue of a first side part 4 and also a second side part 5. The side parts 4, 5 are arranged parallel with respect to one another and comprise cut-outs 11 that are provided so as to receive plug connector modules. The plug connector modules are accordingly configured in order to be able to simultaneously receive the side parts 4, 5 in the cut-outs 11.

Connecting regions 7 are provided in each case on two ends of the first side part 4 and also of the second side part 5. The connecting regions 7 are used to connect the side parts 4, 5 to a first head part 2 and a second head part 3. For this purpose, each of the head parts 2, 3 comprises two receiving arrangements 6 that are configured as a slot and in each case receive a connecting region 7 of a side part 4, 5. The side parts 4, 5 comprise respectively fastening means 10, 12 for fastening the side parts 4, 5 to one another and for bracing said side parts against the head parts 2, 3.

The fastening means 10, 12 are configured in such a manner that the opposite-lying fastening means 10, 12 of the first side part 4 and of the second side part 5 can be connected respectively to one another. In this exemplary embodiment, the first fastening means 10 is configured as a screw and the second fastening means 12 is configured as a screw sleeve having an inner thread. The screw of the first fastening means 10 can be screwed into the thread of the second fastening means 12. The first side part 4 can thus be connected to the second side part 5 and simultaneously the head parts 2, 3 are clamped between the side parts 4, 5.

Fastening ends 9 are provided on the head parts 2, 3. These fastening ends are used to fasten the entire holding frame 1 in a plug connector housing or in a housing opening or device opening.

Figure 2:
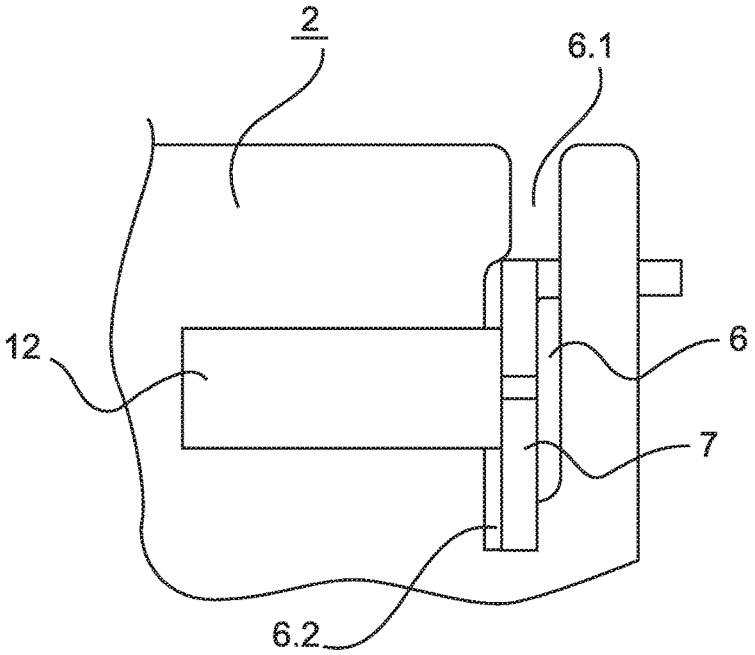
FIG. 2 illustrates a detailed view of a head part of the first exemplary embodiment.

FIG. 2 illustrates a detailed view of the first head part 2 of the first exemplary embodiment. A section of the first head part 2 having the receiving arrangement 6 that is configured as a slot. The connecting region 7 of the second side part 5 is inserted in the receiving arrangement 6.

The slot is configured as S-shaped so as to improve the manner in which the connecting region 7 is connected in the receiving arrangement 6. The opening 6.1 of the slot lies further in the outer region of the first head part 2 than the end 6.2. In other words, the ends 6.2 of the slots of the two receiving arrangements 6 of the first head part 2 lie closer together than the openings 6.1. This configuration of the slots ensures that in the case of the side parts 4, 5 being connected by means of the fastening means 10, 12, the connecting regions 7 cannot slide out of the receiving arrangements 6. The connecting regions 7 are located in the ends 6.2 of the slots. The fastening means prevent the two side parts 4, 5 being pulled apart. The connecting regions 7 therefore cannot slide through the openings 6.1 of the slots, said openings lying further apart from one another.

Figure 3:
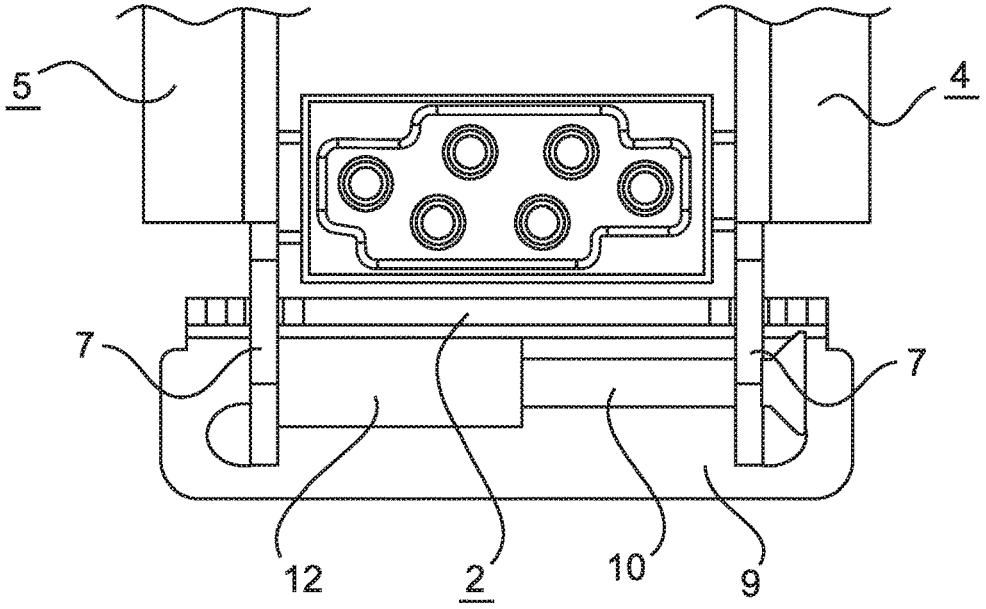
FIG. 3 illustrates the head part of the first exemplary embodiment with inserted side parts.

FIG. 3 illustrates once more the first head part 2 of the first exemplary embodiment with inserted side parts 4, 5. The fastening means 10, 12 are not entirely connected to one another. The connecting regions 7 of the side parts 4, 5 lie so far away from one another that they are located in the openings 6.1 of the receiving arrangements 6 and could be pulled out. A plug connector module between the first side part 4 and the second side part 5 can be pulled out or inserted in this assembly position.

Figure 4:
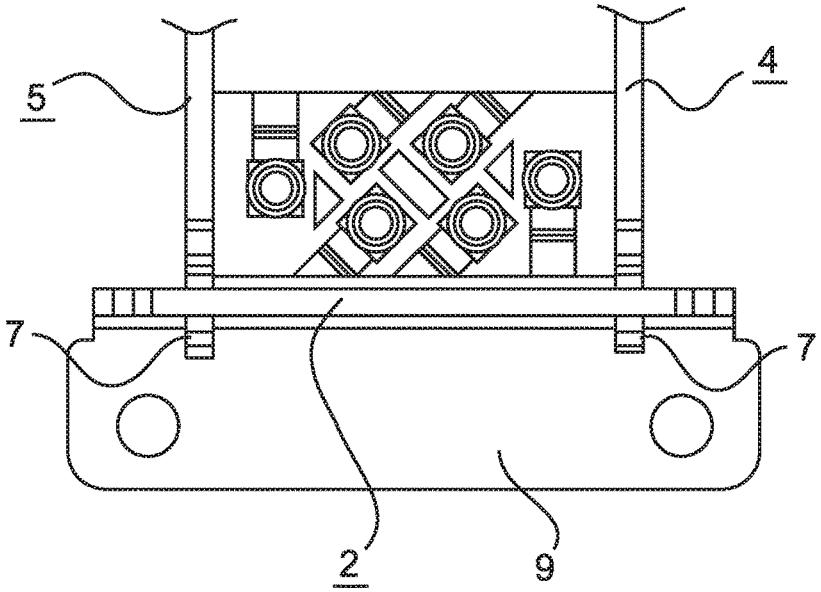
FIG. 4 illustrates a head part having inserted side parts of a second exemplary embodiment.

A first head part 2 having inserted side parts 4, 5 of a second exemplary embodiment is illustrated in FIG. 4 in the same view as in FIG. 3. However, in this illustration the side parts 4, 5 are entirely connected to the first head part 2. A plug connector module is inserted and fastened between the first side part 4 and the second side part 5.

This specific embodiment does not comprise fastening means that connect the side parts 4, 5 to one another. In this embodiment, the connecting regions 7 of the first side part 4 and of the second side part 5 latch directly in the receiving arrangements 6 of the first head part 2. As a consequence, additional assembly steps—screwing in the side parts 4, 5 of the first exemplary embodiment—are omitted.

Figure 5:
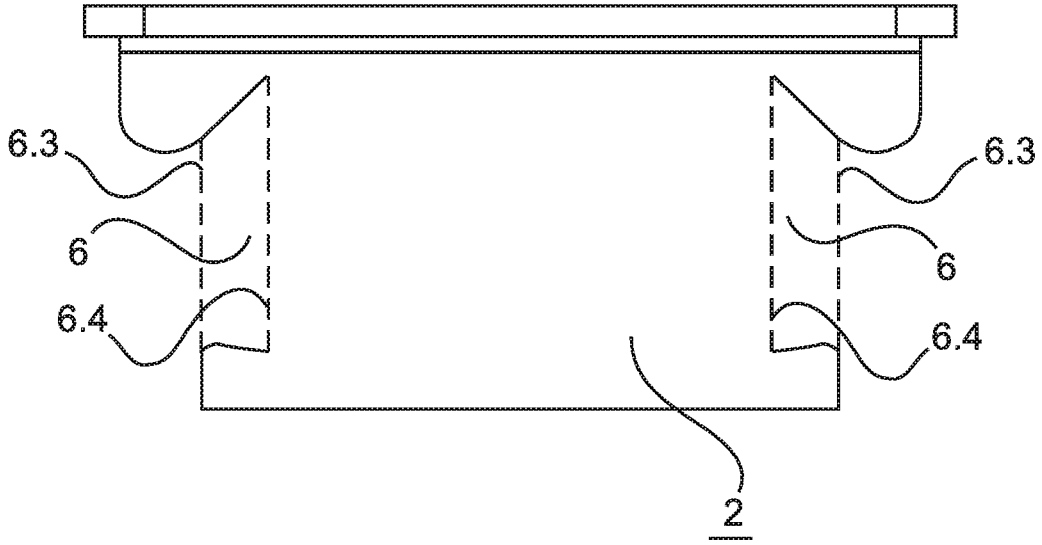
FIG. 5 illustrates the head part of the second exemplary embodiment.

FIG. 5 illustrates a view of the first head part 2. The receiving arrangements 6 are evident and are configured in this exemplary embodiment as a trapezoidal recess. The receiving arrangements 6 are provided in the first head part 2 in such a manner that the in each case short base side 6.3 of the trapezoidal recess is used as an opening of the receiving arrangement 6. It is possible by way of the opening to insert the connecting regions 7 of the side parts 4, 5 into the receiving arrangement.

For this purpose, the trapezoidal recess comprises a more acute angle in the upper illustrated region of the longer base side 6.4 than in the lower region. The connecting region 7 can thus be inserted into the upper region and then can be folded in the lower region until the connecting region 7 lies on the longer base side 6.4 of the trapezoidal recess (cf., FIG. 7).

Figure 6:
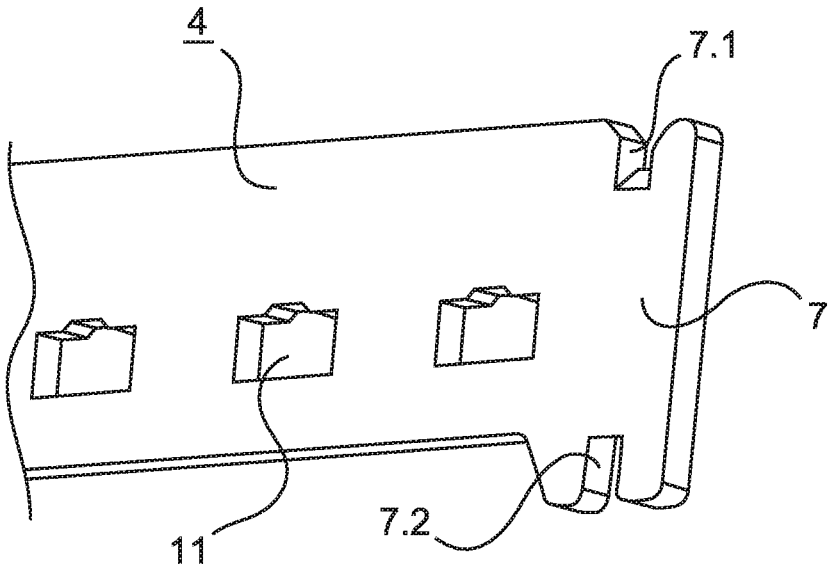
FIG. 6 illustrates a side part of the second exemplary embodiment.

The connecting regions 7 of the side parts 4, 5 are complemented in this exemplary embodiment by two recesses, as illustrated in FIG. 6. A first recess 7.1 in the upper illustrated region, and also a second recess 7.2 in the lower illustrated region of the connecting region 7. The recesses 7.1, 7.2 are dimensioned so that they correspond to the thickness of the head parts 2, 3. The head parts 2, 3 can thus sit in the assembled state in the recesses 7.1, 7.2 and avoid the side parts 4, 5 sliding laterally out of the head parts 2, 3.

Figure 7:
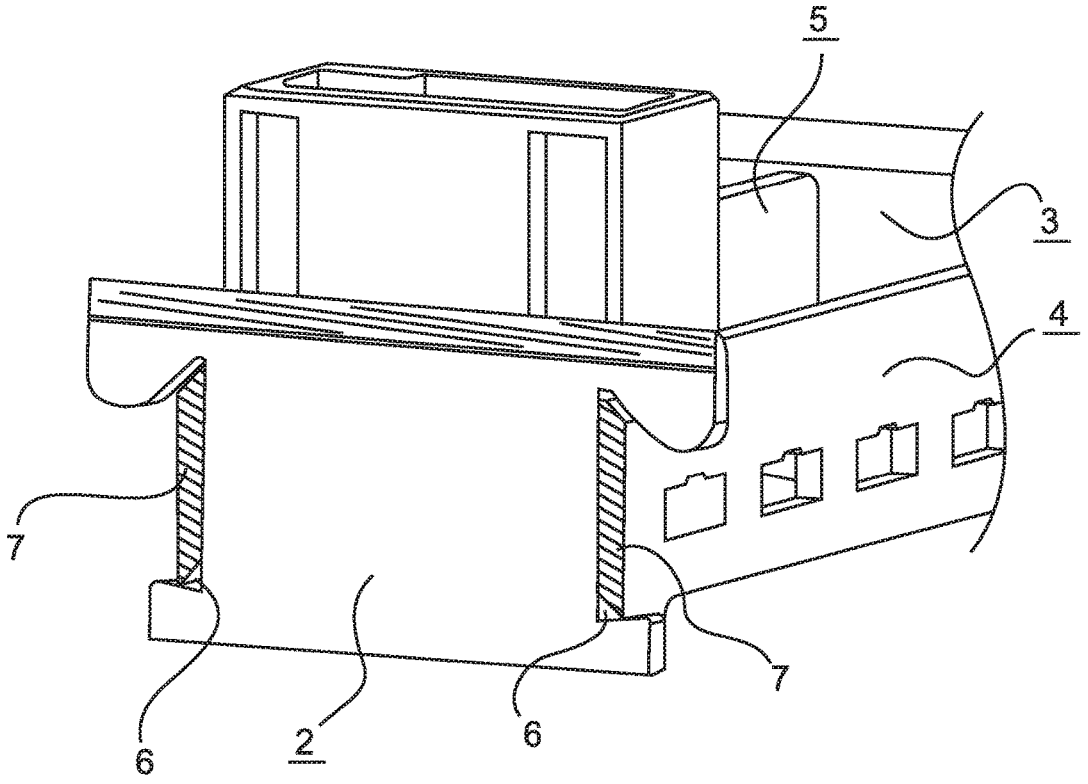
FIG. 7 illustrates a perspective sectional view of a holding frame of the second exemplary embodiment.

An assembled holding frame 1 of the second exemplary embodiment is illustrated in FIG. 7 in a spatial sectional view. The end regions of the first side part 4 and of the second side part 5 have not been illustrated. The view thus renders it possible to see the connecting regions 7 of the side parts 4, 5 inserted into the receiving arrangements 6 of the first head part 2. The connecting regions 7 lie on the longer base sides 6.4 of the trapezoidal recesses that form the recesses 6.

The trapezoidal shape of the recesses is provided for the purpose of latching the connecting regions 7 in the receiving arrangements 6 and ensuring that said connecting regions cannot be pulled out without applying force. It is necessary in the lower illustrated region to pull the side parts 4, 5 away from one another and to pull said side parts out of the receiving arrangement 6 in order to be able to disassemble the holding frame 1. Afterwards, the side parts 4, 5 can be pulled out and entirely removed in the upper region.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame for holding plug connector modules and for installing in a plug connector housing or for screwing to wall surfaces, wherein cut-outs for receiving the plug connector modules are provided on two opposite-lying sides of the holding frame, wherein the cut-outs are configured as laterally closed, through-going openings in the sides of the holding frame, wherein the holding frame is embodied from four parts that are connected to one another, wherein two opposite-lying side parts form the sides of the holding frame, wherein the side parts are connected to one another by two head parts, wherein the head parts in each case form a fastening end of the holding frame, wherein in each case two recesses are configured as receiving arrangements on the head parts, wherein the side parts in each case form two end-side connecting regions, wherein the connecting regions is inserted into the receiving arrangements, and wherein the side parts of the holding frame are connected to one another in the connecting regions by a first fastening means and a second fastening means.

2. The holding frame as claimed in claim 1, wherein the first fastening means is a screw and the second fastening means is a thread.

3. The holding frame as claimed in claim 1, wherein the receiving arrangements are configured as slots having in each case an opening and an end in the head parts, wherein the openings of the slots lie further away from one another than the ends of the slots.

4. The holding frame as claimed in claim 3, wherein the slots that form the receiving arrangements are configured as S-shaped.

5. The holding frame as claimed in claim 1, wherein the receiving arrangements are configured as trapezoidal recesses in the head parts, wherein in each case the shorter base sides of the trapezoidal recesses are used as openings of the receiving arrangements.

6. The holding frame as claimed in claim 5, wherein in each case two opposite-lying recesses are configured in the connecting regions of the side parts.

7. The holding frame as claimed in claim 6, wherein the connecting regions is inserted into the receiving arrangements in the region between the recesses.

8. The holding frame as claimed in claim 1, wherein, for each head part, the recesses extend from an upper end of the head part in a direction parallel to the sides of the holding frame and insertably receive a respective one of the end-side connecting regions of the side parts such that portions of the head part are located on each of opposing lateral sides of the end-side connecting regions.

9. The holding frame as claimed in claim 1, wherein the recesses of the head parts are open ended and shaped to enable the side parts to be inserted in a receiving direction parallel to the sides of the holding frame and to enable the side parts to move toward each other to an assembled configuration in which the side parts are then unable to be removed from the head parts in a direction opposite the receiving direction.

10. The holding frame as claimed in claim 1, wherein, for each head part, the recesses extend from opposing lateral ends of the head part in a direction toward a central region of the head part to insertably receive the end-side connecting regions of the side parts.

11. The holding frame as claimed in claim 10, wherein, for each recess, an opening side of the recess is narrower than a base side of the recess to assist in captively receiving a respective one of the end-side connecting regions of the side parts.

12. A holding frame for holding plug connector modules, comprising:

a frame structure embodied from two opposite-lying side parts that form sides of the holding frame and two opposite-lying end head parts that connect the side parts together, wherein the side parts include cut-outs in the form of through-going openings in the sides of the holding frame for receiving the plug connector modules, and wherein each head part includes two open ended recesses that each extend from an upper end of the head part in a direction parallel to the sides of the holding frame and insertably receive an end portion of a respective one of the side parts such that portions of the head part are located on each of opposing lateral sides of said end portions of the side parts, and wherein the side parts of the holding frame is connected to one another in the end regions by a first fastening means and a second fastening means.

13. The holding frame as claimed in claim 12, wherein the recesses of the head parts are shaped to enable the side parts to be inserted in a receiving direction parallel to the sides of the holding frame and to enable the side parts to move toward each other to an assembled configuration in which the side parts are then unable to be removed from the head parts in a direction opposite the receiving direction.

14. A holding frame for holding plug connector modules, comprising:

a frame structure embodied from two opposite-lying side parts that form sides of the holding frame and two opposite-lying end head parts that connect the side parts together, wherein the side parts include cut-outs in the form of through-going openings in the sides of the holding frame for receiving the plug connector modules and wherein each head part includes two open ended recesses that each insertably receive an end portion of a respective one of the side parts, each recess extending from a respective lateral end of the head part in a direction toward a central region of the head part, and wherein the side parts of the holding frame are connected to one another in the end regions by a first fastening means and a second fastening means.

15. The holding frame as claimed in claim 14, wherein for each recess, an opening side of the recess is narrower than a base side of the recess to assist in captively receiving the end portion of the respective one of the side parts.

* * * * *